United States Patent [19]

Farnsteiner

[11] 3,930,615

[45] Jan. 6, 1976

[54] SPRAY GUN WITH LOW PRESSURE AIR

[76] Inventor: Irmgard Farnsteiner, Residence Auteuil, Bd du Tenao, Monte Carlo, Monaco

[22] Filed: Jan. 28, 1975

[21] Appl. No.: 544,750

[30] Foreign Application Priority Data

Feb. 1, 1974 France ..... 74.04744

[52] U.S. Cl. ..... 239/419.5

[51] Int. Cl.[2] ..... F23D 11/16; F23D 13/40; F23D 15/00

[58] Field of Search..... 239/419.5, 415, 416.1, 239/528, 353

[56] References Cited

UNITED STATES PATENTS 2,513,523 7/1950 Schafer ..... 239/419.5

3,796,376 3/1974 Farnsteiner ..... 239/419.5

*Primary Examiner*—Lloyd L. King

*Attorney, Agent, or Firm*—Young & Thompson

[57] ABSTRACT

A spray gun with a retractable stem for opening a spray jet to the outflow of a liquid to be sprayed, also opens the compressed air inlet upon rearward movement of the stem. The compressed air flows about the stem and into a venturi throat through which the stem passes. The venturi educts atmospheric air so that the air that atomizes the liquid is at greatly reduced pressure. Rearward movement of the stem is also effected by compressed air that actuates a piston to move the stem rearwardly.

4 Claims, 2 Drawing Figures

SPRAY GUN WITH LOW PRESSURE AIR

The present invention relates to spray guns with low pressure air for atomizing a liquid to be sprayed. One of the fields of application of the present invention is that of paint spray guns, for example automatic paint spray guns in a painting line which are actuated at the moment when an article to be painted passes in front of them.

Known guns of this type use spraying air at a pressure of 2 to 5 kg/cm², and have two compressed air inlets, one for spraying and the other to control the opening and closing of the spray nozzle.

It is an object of the present invention to provide a spray gun for the atomization of a liquid to be sprayed, in which the spraying air is supplied at relatively low pressure.

Another object of the present invention is to provide such a spray gun, in which the spraying air can be supplied at a relatively high pressure but is actually used at a relatively low pressure.

Still another object of the present invention is the provision of such a spray gun, which will be relatively simple and inexpensive to manufacture, easy to install, operate, maintain and repair, and rugged and durable in use.

Briefly, the objects of the present invention are achieved by providing a spray gun having a retractable stem to open and close the jet through which the liquid to be sprayed is emitted, and a compressed air supply which is opened by rearward or opening movement of the stem. The compressed air flows about the stem forwardly through a venturi throat through which the stem passes. The venturi throat educts atmospheric air, so that the pressure of the compressed air is greatly reduced. The air of reduced pressure then atomizes the liquid in the usual way. Rearward movement of the stem to open position may be effected also by compressed air acting on a piston that moves with the stem. The compressed air may for example be supplied at a pressure of 2–5 kg/cm² gauge, and may be thus reduced in pressure to about 0.1 to 0.3 kg/cm² gauge.

Figure 1:
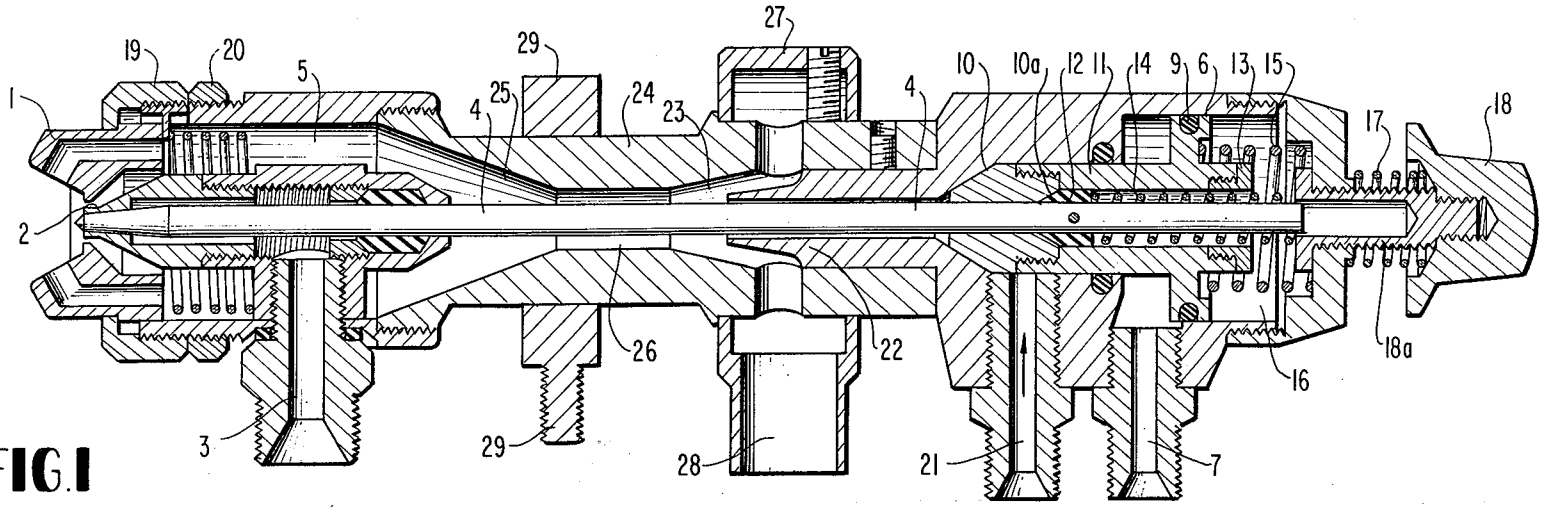
Figure 2:
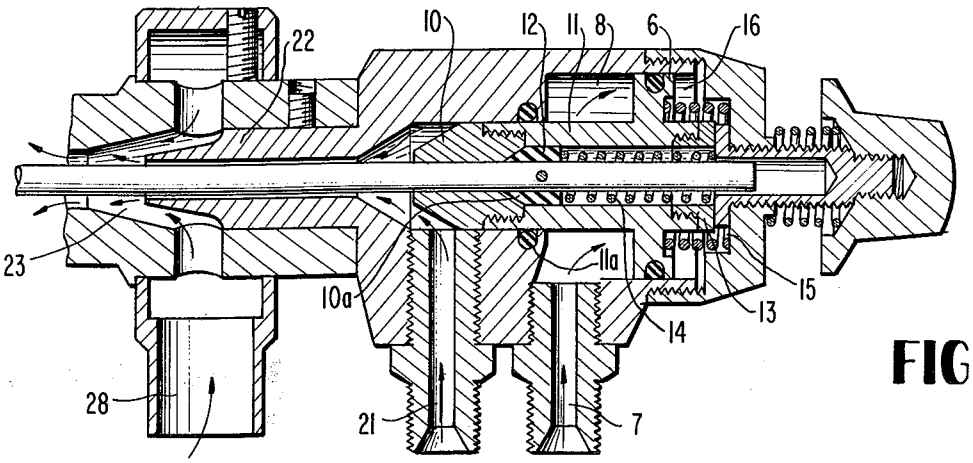

Other objects, features and advantages of the present invention will become apparent from a consideration of the following description, taken in connection with the accompanying drawing, in which:

FIG. 1 is a cross-sectional view of a spray gun according to the present invention, in closed position; and FIG. 2 is a view similar to FIG. 1 of the rear portion of the gun, but in open or operating position.

Referring now to the drawing in greater detail, there is shown a spray gun according to the present invention comprising a paint spray gun having a front nozzle 1, a spray orifice 2 through which liquid to be atomized is emitted, a liquid inlet conduit 3, an elongated stem 4 which in its forward position closes orifice 2 and which in its rearward position opens orifices 2 to the flow of liquid therethrough, an annular chamber 5 for compressed air, and a piston 6 that moves with stem 4. A compressed air inlet 7 at the rear of the gun opens into a chamber 8 to operate piston 6, piston 6 sealing against the inner side walls of chamber 8 by an O-ring seal 9. Piston 6 terminates at its forward end in a cone 10 having a conical recess 10*a* at its rear, cone 10 being screw-threadedly connected to the hollow shaft 11 of piston 6 which in turn slidably seals against the body of the spray gun by an O-ring seal 11*a*. A conical plug 12 is pin-secured to stem 4 and fits in conical recess 10*a*.

A cylindrical sleeve 13 screws into the piston 6 and with the interior of piston 6 has an internal diameter sufficient to receive a return spring 14 that bears against plug 12 to urge plug 12 and stem 4 forwardly to the closed position of stem 4 in orifice 2.

A return spring 15 urges piston 6 toward the left as seen in the drawing, so that plug 10 closes the axial bore within the gun, thereby to enlarge chamber 16. Finally, a spring 17 bears against a knurled knob 18 which upon being manually rotated rotates a stem 181*a* screwed within the gun to regulate the rearward movement of sleeve 13 and hence to limit the amount by which stem 4 can be moved to the right to open orifice 2.

At the forward end of the gun, two rings 19 and 20 enable the head of the gun to be adjusted axially in a well-known manner so as to control the spray to produce a wider or narrower spray or a coarser or finer atomization.

A further compressed air inlet 21 is closed by cone 10 and shaft 11 in the FIG. 1 position and opened in the FIG. 2 position. Thus, when compressed air is supplied through inlet 7 to force piston 6 to the right as seen in FIG. 2, compressed air inlet 21 is open; but when compressed air is not supplied to inlet 7, and the piston 6 occupies its FIG. 1 position, compressed air inlet 21 is closed. Compressed air at a pressure of, say, 2 to 5 kg/cm² gauge thus enters through inlet 21; and in the open or FIG. 2 position, this compressed air passes about stem 4 through an injection nozzle 22 and thence into a converging conical chamber 23 which is on the upstream side of a venturi throat 24 whose downstream side is characterized by a diverging conical chamber 25. A relatively narrow channel 26 interconnects chambers 23 and 25. Surrounding injection nozzle 22 and chamber 23 is an annular chamber 27 that communicates at 28 with atmospheric air, which is inducted by the venturi so that the pressure in chamber 25 will be desirably low, for example 0.1 to 0.3 kg/cm² gauge. This low pressure spraying air then enters annular chamber 5 and thereafter atomizes the liquid in a well-known manner.

It is thus possible to use a relatively high pressure source of compressed air through inlet 21, but to conserve this compressed air by greatly reducing its pressure and greatly increasing the volume of supplied compressed air, so that a relatively large volume of relatively low pressure air emerges from the left end of the gun as seen in the drawing, for effective atomization with the need to supply only a relatively small volume of compressed air in the first instance.

If the gun of the present invention is used in the particular environment of, say, an automatic paint spray installation in which objects to be painted pass in front of the gun and trigger the operation of the gun in a well known manner, then the gun can for example be fixedly mounted on a bracket 29 to a conventional support structure (not shown).

In view of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

Having described my invention, I claim:

1. In a spray gun comprising a gun body, a liquid outlet from the gun body for liquid to be atomized, means to supply liquid to said outlet, a stem reciprocable in the body to open and close the outlet, means to reciprocate the stem in the body, means to supply compressed air to the body to atomize the liquid emerging from said outlet; the improvement comprising a venturi throat in said body through which said compressed air passes, means to induct atmospheric air into said venturi thereby to reduce the pressure of the air that emerges from said venturi, valve means for the inlet of said compressed air, said valve means comprising an annular member surrounding said stem and reciprocable lengthwise with said stem to open and close said inlet for said compressed air, said valve means comprising an annular piston reciprocable in said body and surrounding said stem, and means to supply compressed air to said piston to reciprocate said piston to open and close said compressed air inlet and said liquid outlet.

2. A spray gun as claimed in claim 1, in which the throat of said venturi surrounds said stem with clearance.

3. A spray gun as claimed in claim 1, said annular member being carried by said piston and extending from said piston in the direction of said outlet.

4. A spray gun as claimed in claim 1, said stem and valve means and annular member and piston being coaxial and axially reciprocable together as a unit.

* * * * *